US006114615A

United States Patent [19]

Larudee

[11] Patent Number: 6,114,615

[45] Date of Patent: Sep. 5, 2000

[54] STEPPED TUNING PIN FOR PIANOS AND LIKE INSTRUMENTS

[76] Inventor: Paul S. Larudee, 405 Vista Heights Rd., Richmond, Calif. 94805

[21] Appl. No.: 09/195,062

[22] Filed: Nov. 18, 1998

[51] Int. Cl.[7] ..... G10C 3/10

[52] U.S. Cl. ..... 84/201; 84/200

[58] Field of Search ..... 84/200, 201

[56] References Cited

U.S. PATENT DOCUMENTS

| | | | |
|---|---|---|---|
| 638,154 | 11/1899 | Walker | 84/201 |
| 2,075,001 | 3/1937 | Schulze | 84/201 |
| 4,398,443 | 8/1983 | Kovach . | |

*Primary Examiner*—Bentsu Ro
*Assistant Examiner*—Shih-Yung Hsieh
*Attorney, Agent, or Firm*—H. Michael Brucker

[57] ABSTRACT

A tuning pin for pianos and other string instruments being of one diameter size for approximately one-third of its length and of another diameter for the remainder of its length.

3 Claims, 4 Drawing Sheets

STEPPED TUNING PIN FOR PIANOS AND LIKE INSTRUMENTS

BACKGROUND OF THE INVENTION

The present invention relates to tuning pins for stringed instruments and, in particular, to tuning pins for pianos.

A standard piano tuning pin is a generally cylindrical steel rod, sometimes coated to resist corrosion, usually between 2 and 2-½inches in length and available in six different diameter sizes, ranging from 0.276" to 0.301". Other sizes are available for instruments such as harpsichords and zithers. The pins used universally today have remained essentially unchanged in design for the last 150 years, and modern tuning tools can be used without modification on instruments dating from the mid-19th century.

A piano string is tuned by rotating the tuning pin around which one end of the string is coiled. This partially winds or unwinds the string, which increases or decreases the tension, thus raising or lowering the pitch. In a standard tuning, each pin is normally rotated no more than a few degrees of arc in order to bring the string to the correct pitch, and part of the tuner's skill lies in his or her ability to control extremely fine movement of the tuning wrench. Pins of the smallest possible diameter are preferred because they yield less change in tension for a given arc of rotation, thus permitting greater tuning precision. On the other hand, smaller pins are less sturdy and can fail under the loads required in piano design. As a consequence, the pins which are used in piano manufacture are typically of a greater diameter than desirable for tunability in order to meet structural needs.

BRIEF SUMMARY OF THE INVENTION

The present invention reconciles the opposing needs for large and small diameters in tuning pins by providing, for the first time, a combination of two sizes in one pin. It is of the same configuration as a standard pin, except that it is of a larger diameter for most of its structure-bearing length and of a smaller diameter from the point where it meets the music wire to the end which fits into the tuning wrench. This reduces torque and provides greater tunability in the smaller section while providing greater strength and rigidity in the larger. It also reduces the need to replace pin blocks as frequently in rebuilt instruments by allowing the use of larger pins without sacrificing tunability, as well as other benefits to manufacturers, rebuilders and tuner/technicians.

DETAILED DESCRIPTION OF THE INVENTION

Figure 1:
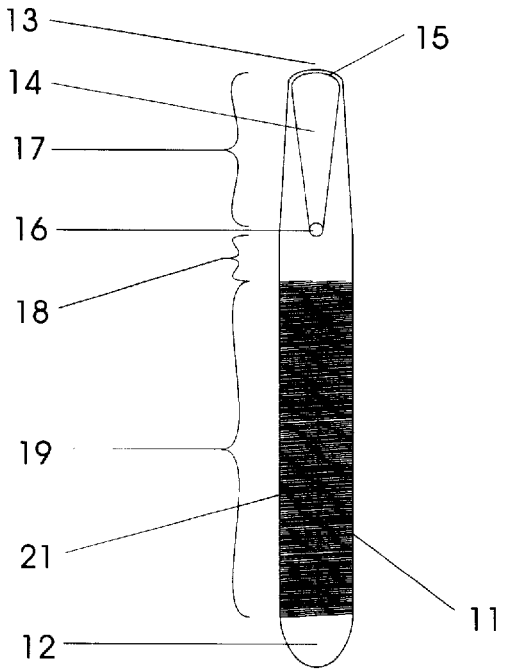
FIG. 1 PRIOR ART
FIG. 1 is a side view of a prior art tuning pin.
Figure 1A:
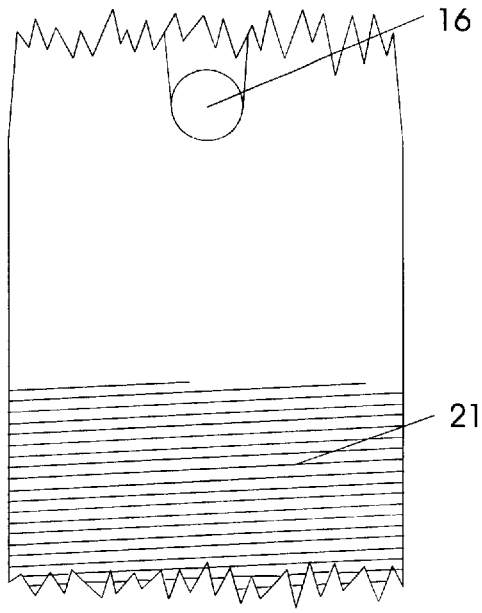
FIG. 1a PRIOR ART
FIG. 1*a* is an enlarged view of a portion of FIG. 1.
Figure 2:
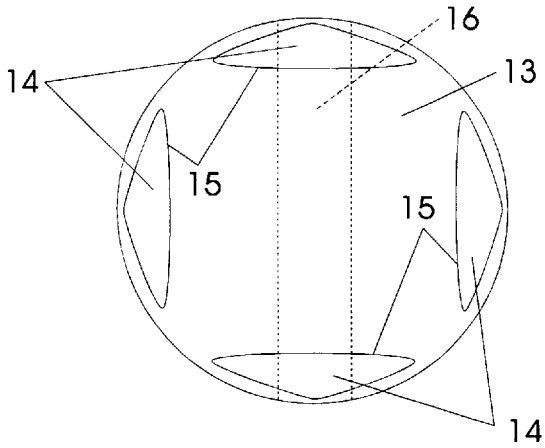
FIG. 2 PRIOR ART
FIG. 2 is a top view of FIG. 1.

Referring to FIGS. 1, 1*a* and 2, a standard prior art tuning pin 11 has at one end a nose 12 which is nearly hemispheric in shape, while the other end, called the crown 13, is also rounded, but more gently, with a longer radius. The crown 13 is also squared at the edges as a result of four bevels 14 which begin farther down the pin and gently taper until the edges 15 of the bevels 14 nearly meet at the crown 13. Two of the bevels on opposite sides of the pin are joined at their starting points by a becket hole 16 which traverses the pin at its diameter. The length of pin 11 from the becket hole 16 to the crown 13 is called the tip 17 and has a noncircular complex cross-section due to the bevels 14. Immediately below the tip 17 (and thus the becket hole 16) is an unmodified section of pin called the trunk 18 which has a circular cross-section and can typically be approximately ¼" in length. The trunk is the length of pin 11 onto which musical wire is wound below the becket hole 16 (see FIG. 3). Except for the nose 12 itself, the remainder of the pin 19, from the bottom of the trunk 18 to the nose 12, is circular in cross-section and is scribed with threads 21.

Referring to FIGS. 3, 3*a*, 4 and 4*a*, in instrument manufacture, a tuning pin 26 is driven into a wooden pin block 27 and wound with music wire 28, which is then stretched to the tension required to resonate at a determined pitch. In a good instrument, pin movement is negligible except when a wrench (not shown) is applied to the bevels 25 for tuning. This requires the pin 26 to resist failure, leverage, flexion and torque.

Pin failure refers to bending, cracking or breaking—i.e., the integrity of the metal of the pin. The chief defenses against pin failure are the selection and quality of metal, the diameter of the pin, and a shape design which minimizes the creation of weak points anywhere along the length of the pin. Failure, when it occurs, is invariably at the becket hole 16 (see FIGS. 1 and 1*a*) where the strain is greatest while tuning and where the removal of metal through the diameter of the pin causes a relative degree of structural weakness.

Pin leverage refers to the side force exerted on the pin 26 by the tension of the music wire 28. Resistance to such movement is a function of pin length—i.e., the depth to which it can be driven into the pin block 27—and pin strength and rigidity, which depend upon the characteristics of the metal as well as the thickness of the pin 26.

Pin flexion refers to the tendency of the pin to flex under tension and is different from pin failure in that it does not imply any metal disintegration. Metal strength and rigidity, as well as pin thickness, are the usual design variables in minimizing pin flexion.

Pin torque refers to the tendency of the pin 26 to rotate in its hole 30 in the pin block 27 due to the tension of wire 28. The counteracting force is the friction between the pin 26 and the surrounding wooden pin block 27 which the threads 35 are designed to enhance. Pin thickness also slightly aids friction by increasing the amount of surface area between the two surfaces. However, the torque itself is greater with thicker pins, so minimal thickness (diameter) is desirable, other factors being equal. Thinner (smaller diameter) pins are also more tunable. A thicker pin moves more string for each degree of arc that it turns, so a thinner pin allows for finer string tension adjustment.

Figure 3:
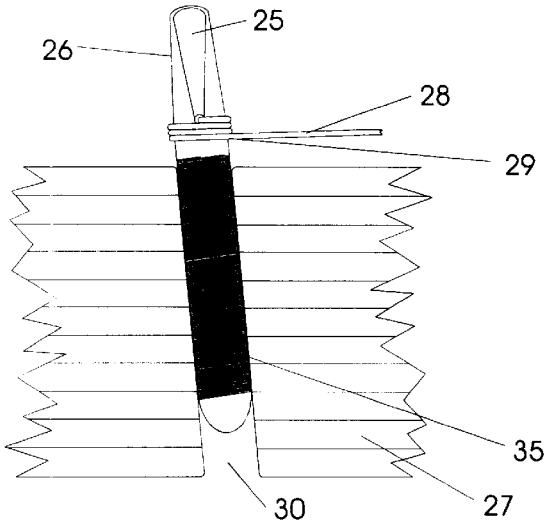
FIG. 3 PRIOR ART
FIG. 3 is a side, partially cut-away view of a prior art tuning pin installed in an open pin block and onto which a music wire has been wound.
Figure 3A:
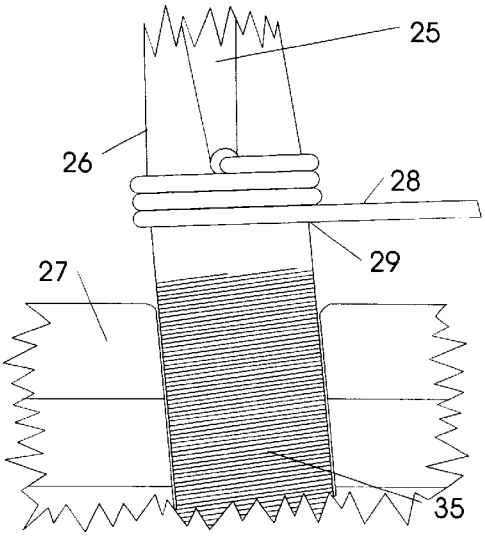
FIG 3a PRIOR ART
FIG. 3*a* is an enlarged view of a portion of FIG. 3.
Figure 4:
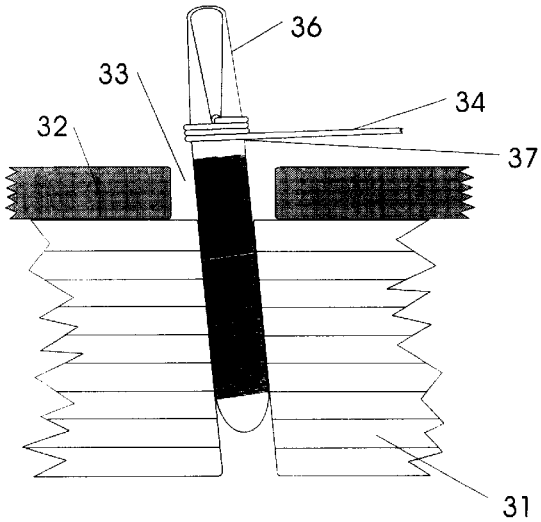
FIG. 4 PRIOR ART
FIG. 4 is the same as FIG. 3 where the pin block is of the closed variety.

The strength and rigidity requirements of pin design favor thick tuning pins, while torque and tunability favor thin ones. Manufacturers deal with these competing considerations in different ways. FIGS. 3 and 4 show two of these ways, in grand piano pin blocks of different designs. FIGS. 3 and 3*a* illustrate an open face pin block 27 where the block is attached to a cast iron structural plate (not shown in FIG. 3) in such a way that the area where the tuning pin 26 is driven is completely open or free of plate metal. This allows the pin 26 to be driven so that the music wire 28 wraps the pin at a point 29 very close to the block 27 which greatly minimizes the effect of flexion and leverage. Accordingly, the smallest pin (size 1) is commonly used in this type of piano. Unfortunately, manufacture of this type is difficult and costly and therefore the preserve of only a few top-end (typically European) manufacturers.

Figure 4A:
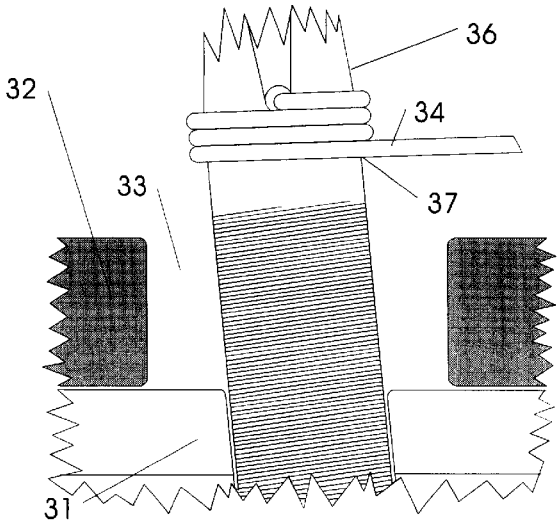
FIG. 4a PRIOR ART
FIG. 4*a* is an enlarged view of a portion of FIG. 4.

FIGS. 4 and 4*a* illustrate a closed face pin block 31 where the cast iron plate 32 completely covers the block except for individual apertures 33 for each pin such as pin 36. Because of the intervening plate 32, the music wire 34 leaves the pin 36 at a point 37 much higher above the pin block 31 itself, allowing the forces of flexion and leverage to have greater impact on the pin structure. Accordingly, few manufacturers use smaller than size 2 pins with this configuration, which is nonetheless easier and less costly to produce.

Rebuilders face an additional consideration because the removal of old pins enlarges the holes in the pin block. Many rebuilders routinely use two sizes larger than the original to assure a tight fit. If a second restringing is required, however, the pins become so big that tunability may be a problem, in which case the entire pin block must be replaced, if the piano is worth the expense.

Figure 5:
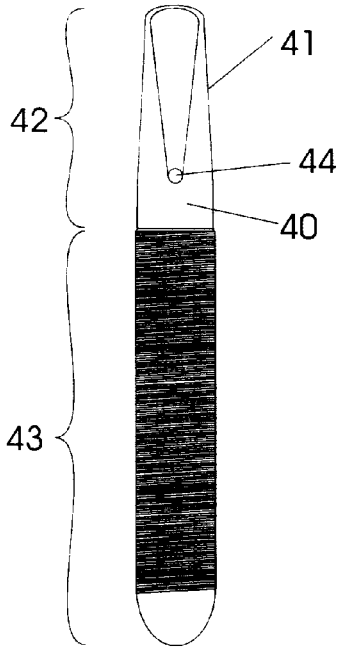
FIG. 5 is a side view of a pin of the present invention.
Figure 5A:
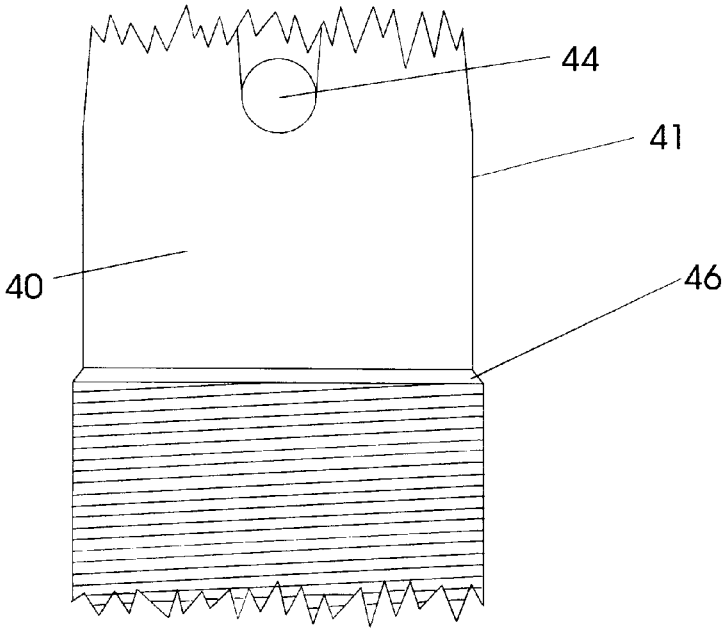
Figure 6:
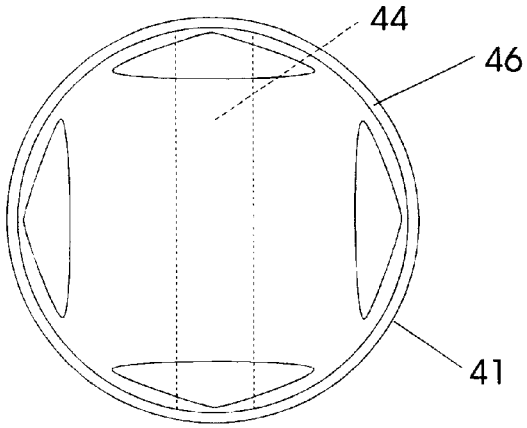
FIG. 6 is a top view of the pin of FIG. 5.
Figure 7:
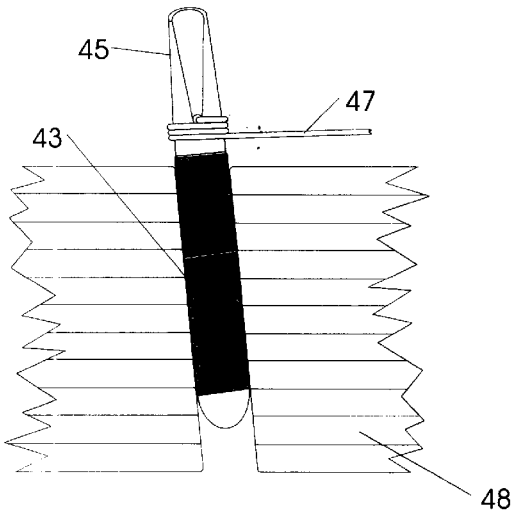
FIG. 7 is a side, partially cut-away view of the pin of the present invention installed in an open pin block onto which a music wire has been wound.
Figure 7A:
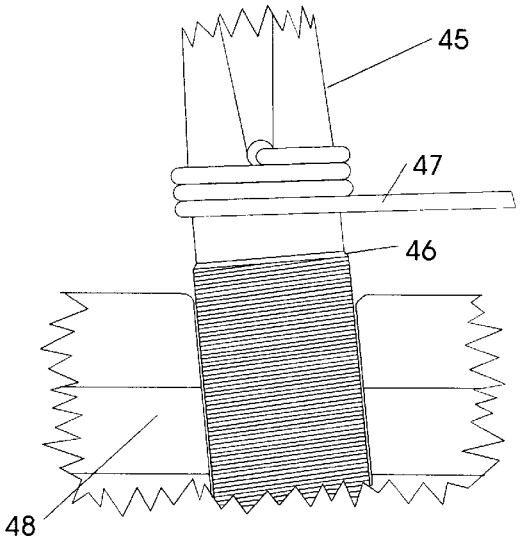
FIG. 7*a* is an enlarged view of FIG. 7.
Figure 8:
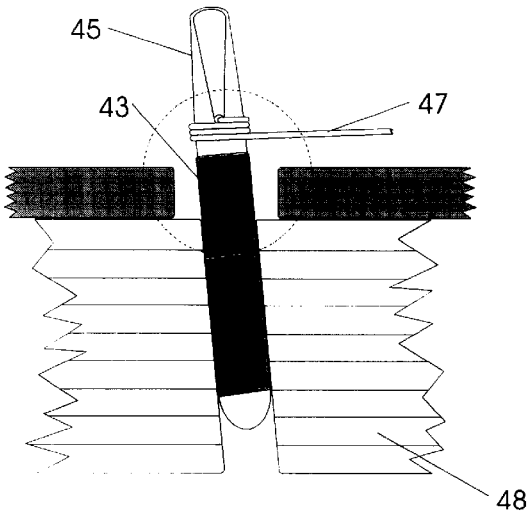
FIG. 8 is the same as FIG. 7, except the pin block is of the closed variety.
Figure 8A:
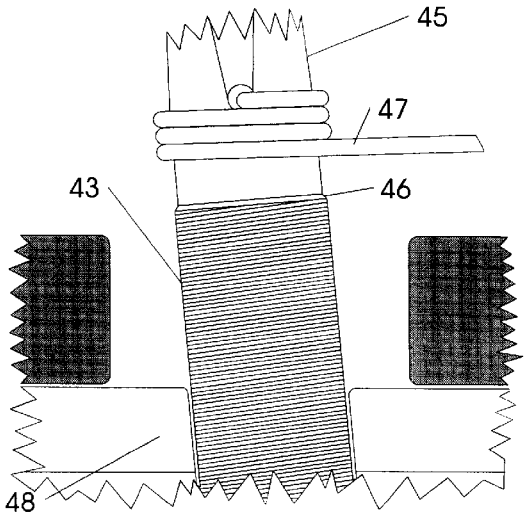
FIG. 8*a* is an enlarged view of a portion of FIG. 8.

Referring to FIGS. 5, 5*a* and 6, a stepped tuning pin 41 of the present invention is designed to overcome some of the constraints of standard tuning pins by combining two sizes of pin in one hybrid unit. The cylindrical trunk 40 and tip of the pin 41, together called the stem 42, are of one size (preferably as small in diameter as permissible), while the cylindrical remainder 43 of the pin, called the root, is of another (normally larger) diameter. This allows the section of the pin 40 (trunk) wrapped with music wire to remain thin for purposes of torque reduction and tunability, while the thicker root 43 preserves as much rigidity as may be required.

Referring to FIGS. 7, 7*a*, 8 and 8*a*, in most applications of the principle, it will be desirable for the interface between the stem and root of the pin 45, called the step 46, to be as high as possible on the pin 45 while remaining below the point at which the music wire 47 leaves the pin 45. Thus, in the preferred embodiment, the step 46 will be located at the bottom of the trunk 40 so that the maximum amount of pin 45 above the pin block 48 will be of the larger diameter. As illustrated, the thicker root section 43 extends above the level of the pin block 48—especially in the case of closed face blocks (FIGS. 8 and 8*a*)—thereby reducing flexion as much as possible.

The difference in diameter between the stem and the root, which creates the step 46, need only be equivalent to one size gradation (approximately 0.004 inches) in order to invest the present invention with a significant measure of the advantages described. However, since each pin size is approximately 4 to 5 thousandths of an inch in diameter larger than the next lower size, even a difference of several pin sizes (up to 25 thousandths) will be small compared to the overall diameter of the pin. Furthermore, as noted earlier, the weakest point will still be at the becket hole 44 (see FIGS. 5, 5*a* and 6), so shear forces at the step 46 are not a significant factor.

As best seen in FIG. 5*a*, step 46 between root 43 and stem 42, has the geometric shape of a section of a cone with its maximum diameter equal to the diameter of the root 43 and its minimum diameter equal to the diameter of the stem 42. In the preferred embodiment, the step 46 is closest to the threads of root 43. By tapering the step diameter transition, the accumulation of stresses at the step is reduced.

Stepped tuning pins, according to the present invention, have a number of other advantages. First, they permit the introduction of new pin sizes. Stems smaller than size 1, for example, can be used to provide finer tunability, while a larger root size maintains the rigidity of the pin as a whole. Second, the step 46 itself provides a visual reference of pin depth, which allows pin driving to be faster and more accurate. Third, large root sizes allow the multiple reuse of pin blocks with enlarged holes, while the smaller stem sizes obviate the corresponding sacrifice of tunability. Finally, the use of small stem sizes allows tuning to be faster and more accurate and permits tuning wrenches to be of fewer sizes.

The stepped tuning pin of the present invention thus has the potential to make piano manufacture, rebuilding and tuning more efficient while improving the performance and tuning stability of the instrument. Furthermore, it can achieve this without any change in existing tools, methods or procedures.

What is claimed is:

1. A stringed-instrument tuning pin having a crown and a nose comprising:

a generally cylindrical root portion having a first diameter;

a stem portion having a cylindrical trunk section of a second diameter wherein said first diameter is larger than said second diameter, and said stem portion further having a tip section between said trunk section and the crown, said entire tip section of a diameter equal to or less than the diameter of said trunk section and having surface bevels that square said stem section near the crown;

a transition portion in the shape of a section of a cone between said root portion and said stem portion wherein said transition portion has a maximum diameter approximately equal to the diameter of said root portion and a minimum diameter approximately equal to the diameter of said stem portion;

wherein said root portion extends from said transition portion to the nose and includes a threaded section, a becket hole in said trunk section.

2. The tuning pin of claim 1 wherein the difference between said first diameter and said second diameter is between approximately 0.004 inches and approximately 0.025 inches.

3. The tuning pin of claim 1 wherein said thread section of said root portion extends from said transition portion to above the nose.

* * * * *